United States Patent [19]

Shieh

[11] Patent Number: 4,991,415

[45] Date of Patent: Feb. 12, 1991

[54] LOCK WITH ELECTRONIC WARNING AND ELECTROMAGNETIC CONTROL SYSTEM

[76] Inventor: Gary Shieh, Fl. 9-4, No. 106, Sec. 3, Hsin-I Rd., Taipei City, Taiwan

[21] Appl. No.: 554,803

[22] Filed: Jul. 18, 1990

[51] Int. Cl.[5] ..... E05B 43/00

[52] U.S. Cl. ..... 70/268; 70/271

[58] Field of Search ..... 70/268, 271, 267, 269, 70/277, 278, DIG. 49

[56] References Cited

U.S. PATENT DOCUMENTS

| | | | |
|---|---|---|---|
| 2,318,908 | 5/1943 | Welch | 70/268 |
| 3,587,081 | 6/1971 | Hawkins | 70/268 |
| 3,608,342 | 9/1971 | Katz | 70/271 |
| 3,670,538 | 6/1972 | Curry | 70/271 |
| 4,734,695 | 3/1988 | Dluhoseh | 70/271 |

*Primary Examiner*—Robert L. Wolfe

*Attorney, Agent, or Firm*—Johnson & Gibbs

[57] ABSTRACT

A lock includes a hollow lock body with a plurality of aligned first transverse holes, a cylindrical key plug rotatably disposed inside the lock body and having a plurality of second transverse holes aligned with the first transverse holes, and a plurality of tumbler pins extending into each set of aligned first and second transverse holes. The lock further includes a first control switch actuated by inserting a key into the key plug, a second control switch actuated by rotating the key plug relative to the lock body, and an electrical control circuitry including a first timer circuit connected to the second control switch, a second timer circuit connected to the first control switch, a warning device and an electromagnetic control unit both actuated by the second timer circuit. The first timer circuit disables the second timer circuit for a predetermined time period when the first timer circuit is actuated. The warning device sends out alarm signals and the electromagnetic control unit prevents the rotation of the key plug for a predetermined period of time if the lock has not been opened after the second timer circuit has counted down a preset time period.

13 Claims, 5 Drawing Sheets

LOCK WITH ELECTRONIC WARNING AND ELECTROMAGNETIC CONTROL SYSTEM

BACKGROUND OF THE INVENTION

The invention relates to a lock, more particularly to a lock with an electronic warning and electromagnetic control system.

Personal safety and protection of property are among the primary concerns of any family. This is the reason more sophisticated and more complicated locks are being manufactured all over the world.

It is a common belief among locksmiths that any lock with a keyhole—the entrance to the inner machinery of the lock—can be picked. The more complicated the lock is, the more time and skill will be required to open it.

SUMMARY OF THE INVENTION

Therefore, the objective of this invention is to provide a lock which sends out an alarm signal if the lock is not opened within a certain time limit.

A further object of this invention is to provide a lock which prevents rotation of the key plug if the lock is not opened within a certain time period.

Accordingly, a lock with an electronic warning and electromagnetic control system of this invention comprises a hollow lock body with a plurality of aligned first transverse holes formed on a receiving groove of the same, a cylindrical key plug rotatably disposed inside the lock body and having a plurality of second transverse holes aligned with the first transverse holes, and a plurality of tumbler pins extending into each set of aligned first and second transverse holes.

A first control switch of the lock is actuated by inserting a key into the key plug. The first control switch includes a conducting plate disposed in the receiving groove, an insulating sleeve member for the conducting plate, and a plurality of conductive contact pieces each having a protruding tip extending inside the insulating sleeve member and slightly displaced from the conducting plate. Each of the conductive contact pieces is movably biased against one of the tumbler pins. The conductive contact pieces are urged by the tumbler pins to make contact with the conducting plate whenever a key or any similar object is inserted into the key plug.

A second control switch of the lock is actuated when the key plug is rotated relative to the lock body. The second control switch includes a hollow casing having a first and a second wall formed with aligned openings. The key plug extends through the hollow casing at the aligned openings. A first and a second conductive contact strip are disposed inside the hollow casing and are slightly displaced from one another. A substantially annular insulating piece is disposed inside the hollow casing and has a level section in contact with the first conductive contact strip. The insulating piece rotates along with the key plug to urge the first conductive contact strip to come into contact with the second conductive contact strip.

An electrical control means includes a first timer actuated by the first and second control switch, a second timer actuated by the first control switch, a warning device and an electromagnetic control unit, the latter two mechanisms being actuated by the second timer. The first timer disables the second timer for a predetermined time period when the first timer is actuated. The warning device sends out alarm signals and the electromagnetic control unit prevents the rotation of the key plug for a predetermined period of time after the actuation of the second timer.

BRIEF DESCRIPTION OF THE DRAWINGS

Other features and advantages of this invention will become apparent in the following detailed description of the preferred embodiment with reference to the accompanying drawings, in which.

DETAILED DESCRIPTION OF THE PREFERRED EMBODIMENT

Figure 1:
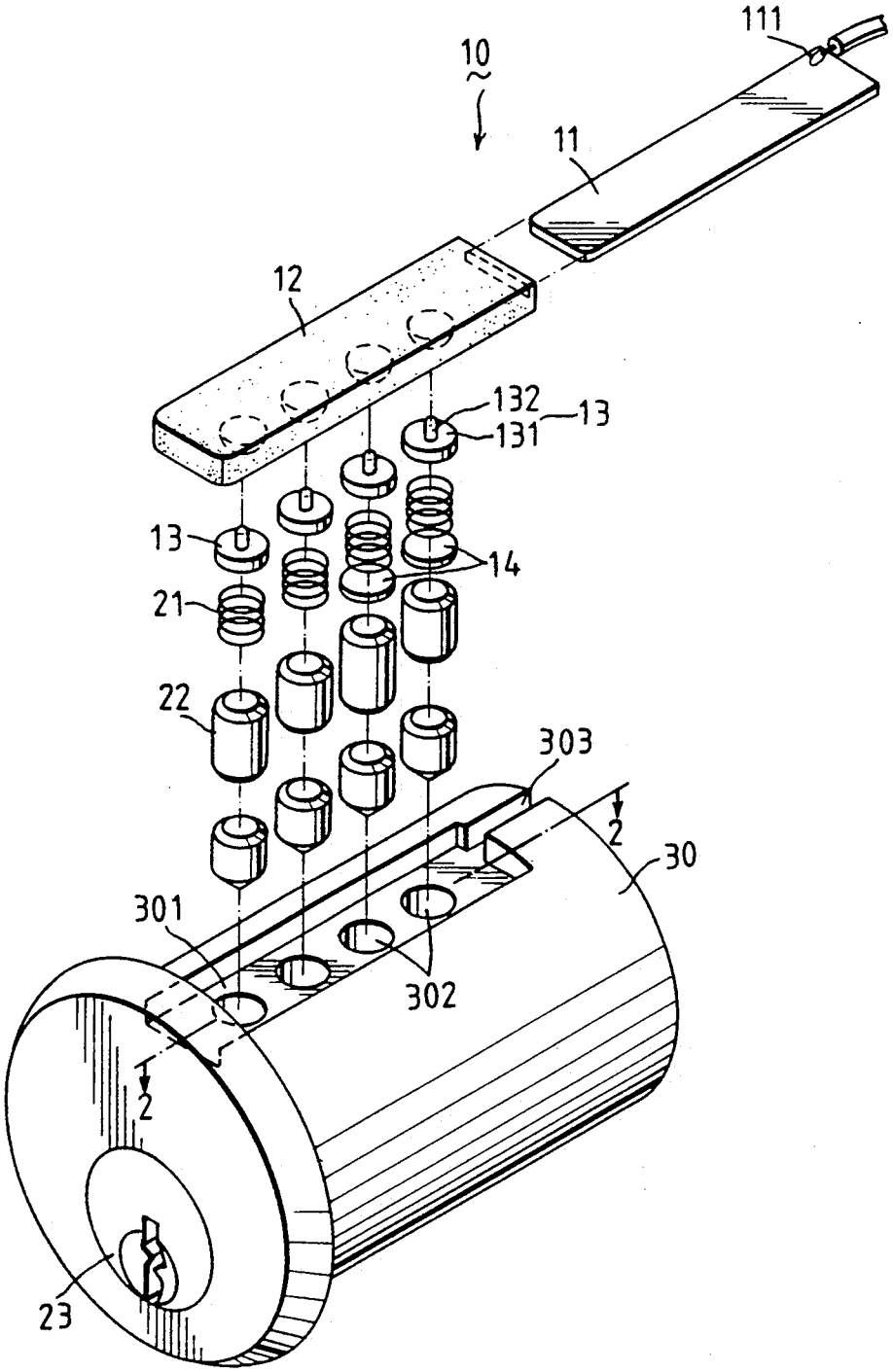
FIG. 1 is an exploded view illustrating a first control switch of the preferred embodiment.
Figure 2:
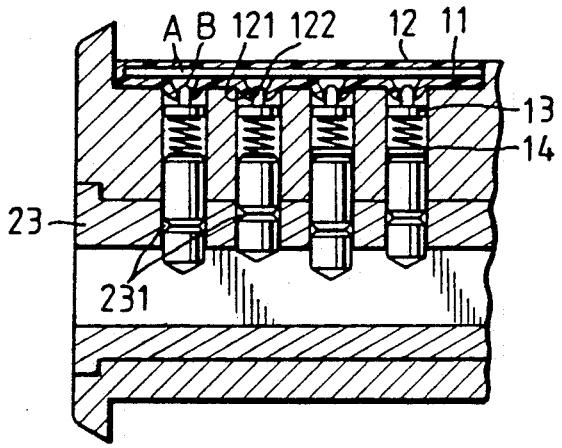
FIG. 2 is a sectional view illustrating the assembly of the first control switch.

Referring to FIGS. 1 and 2, a first control switch 10 of the lock according to this invention is shown to comprise a rectangular conducting plate 11 connected to a conducting wire 111. The rectangular conducting plate 11 is disposed inside an insulating sleeve member 12 made of a flexible rubber material. The insulating sleeve member 12 has a plurality of aligned convex protrusions 121 projecting from its bottom surface. Each of the convex protrusions 121 has a through hole 122.

The lock further comprises a cylindrical lock body 30 with a cylindrical key plug 23 and a rectangular groove 301 formed on the outer surface of the lock body 30 to receive the conducting plate 11. The lock body 30 and the key plug 23 respectively have a plurality of aligned transverse holes 302 and 231 to receive a plurality of tumbler pins 22. Each of the tumbler pins 22 extends inside the key way of the key plug 23 and is suspended from the base 131 of one of a plurality of conductive contact pieces 13 by one of a plurality of biasing means 21. The convex protrusions 121 of the insulating sleeve member 12 project into the transverse holes 302 of the lock body 30. Each of the contact pieces 13 has a protruding tip 132 which extends into the through hole 122 of one of the convex protrusions 121. The protruding tip 132 of each of the contact pieces 13 is slightly displaced from the conducting plate 11. A support plate 14 may be added between each of the biasing means 21 and each of the tumbler pins 22 to urge the protruding tip 132 towards the conducting plate 11.

When a key is inserted into the key plug 23, the biasing means 21 is compressed and the protruding tip 132 of each of the contact pieces 13 is in contact with the conducting plate 11. This defines the open and closed states of the first control switch 10. The closed state of the first control switch 10 means that a closed circuit loop with respect to an electrical control circuit is achieved.

Figure 3:
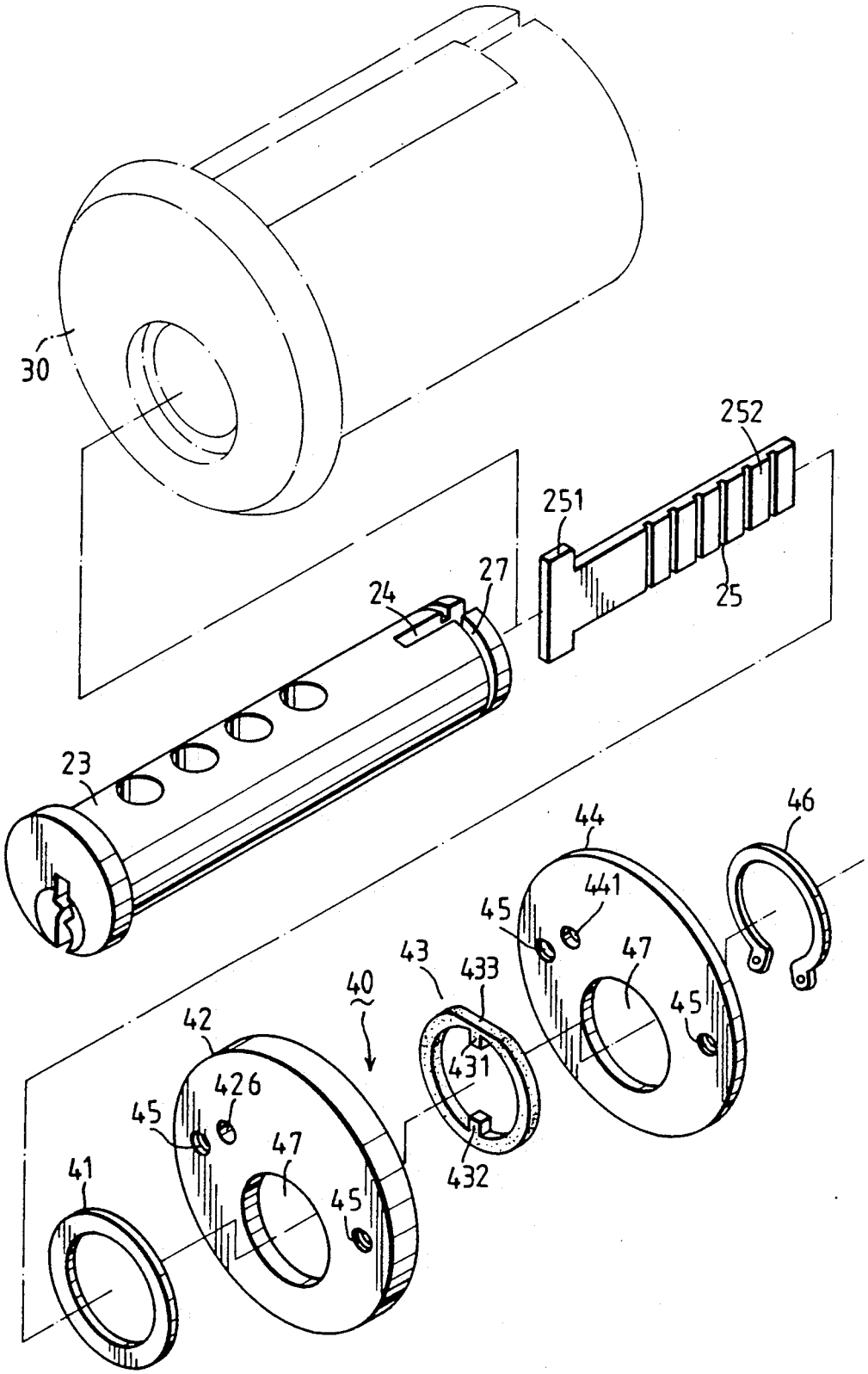
FIG. 3 is an exploded view illustrating a second control switch according to the present invention.

A second control switch 40 of the lock according to this invention is shown in FIG. 3. The rear end of the key plug 23 is formed with an annular groove 27 and a pair of diametrically opposed axial slots 24. A substantially T-shaped latch 25 has a flange end 251 received in the rear end of the key plug 23 and a second end 252 projecting rearward from the axial slots 24. The lock further comprises an annular cushion 41, a circular pan 42, an insulating ring piece 43, and a circular cover piece 44. The circular pan 42 and the circular cover piece 44 each have a pair of mounting holes 45 which are diametrically opposed to each other. The circular pan 42 and the cover piece 44 form a hollow casing used to mount the second control switch 40 therein. The circular pan 42 and the cover piece 44 have aligned circular openings 47. The annular cushion 41, the circular pan 42, the insulating ring piece 43 and the circular cover piece 44 are fitted over the rear end of the key plug 23 in this order. A C-shaped ring 46 engages the key plug 23 at the annular groove 23 to prevent the annular cushion 41, the circular pan 42, the insulating ring piece 43, and the circular cover piece 44 from sliding off the back.

Figure 4:
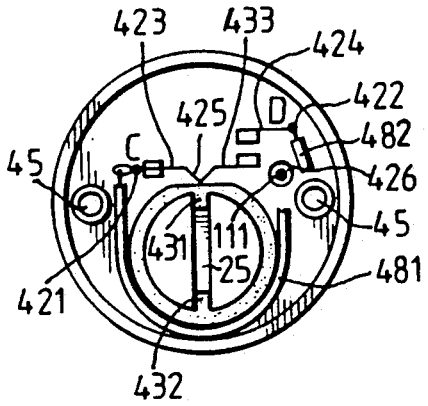
FIG. 4 is a rear view of a partially assembled second control switch to illustrate the assembly thereof.

FIG. 4 is a rear view of the circular pan 42 illustrating the assembly of the second control switch 40. Since the circular pan 42 is mounted over the rear end of the key plug 23, the second end 252 of the T-shaped latch 25 extends out of the circular openings 47. The insulating ring piece 43 has a pair of diametrically opposed inwardly projecting stubs 431 and 432 which extend into the axial slots 24 of the key plug 23 and abut two sides of the T-shaped latch 25. The insulating ring piece 43 is formed with a level section 433. The circular pan 42 is formed with a first and a second inwardly projecting post 421 and 422. A first and a second conductive metal contact strip 423 and 424 are respectively attached to the first and second posts 421 and 422. The first contact strip 423 has a pointed tip 425 formed by bending the first contact strip 423 near its central section. The pointed tip 425 is in contact with the level section 433 of the insulating ring piece as shown in FIG. 4. Conducting wires 481 and 482 are respectively connected to the first and second contact strips 423 and 424. The circular pan 42 and the circular cover piece 44 are each formed with one wire receiving hole, 426 and 441, respectively. The conducting wires 481 and 482 pass through the wire receiving hole 441 so that they can be connected to the electrical control circuit. The conducting wire 111 of the first control switch 10 also passes through the wire receiving hole 441 via an opening 303 formed in the lock body 30 and through the wire receiving hole 426 of the circular pan 42.

When a key is inserted into the keyplug 23 and is used to rotate the same, the T-shaped latch 25 and the insulating ring member 43 are also rotated. As the insulating ring member 43 rotates, its level section 433 urges the pointed tip 425 of the first conducting strip 423 upwards until the first contact strip 423 touches the second contact strip 424. This defines the open and closed states of the second control switch 40. The closed state of the second control switch 40 means that a closed circuit loop with respect to the electrical control circuit is achieved via the conducting wires 481 and 482.

Figure 5:
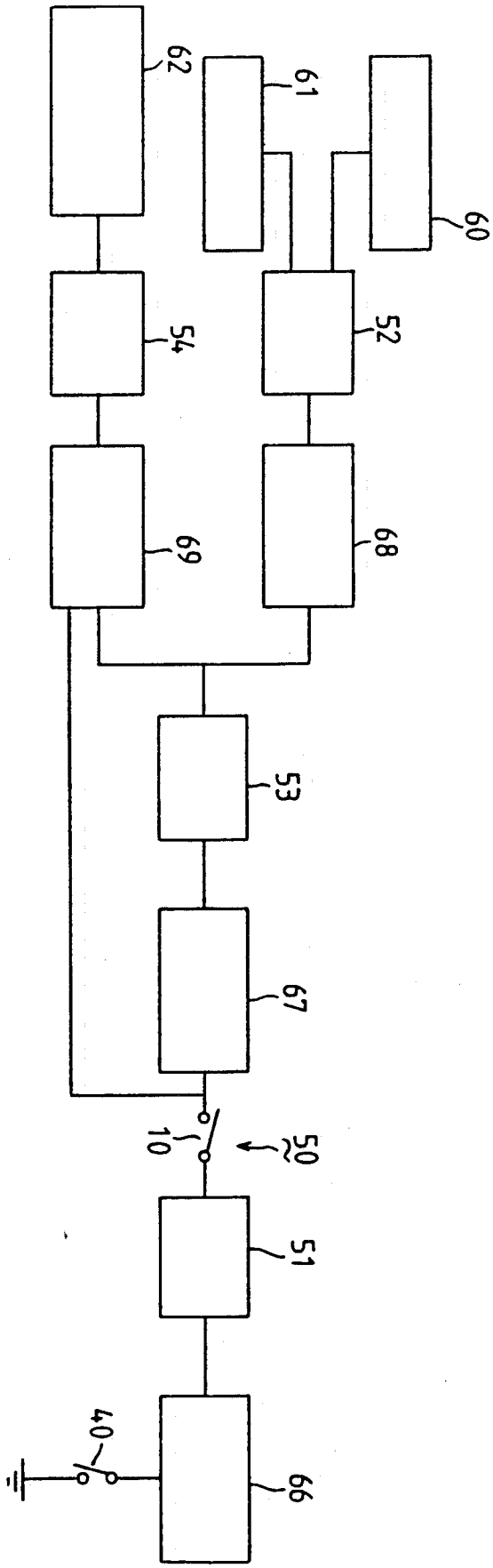
FIG. 5 is a schematic block diagram of an electrical control circuit of a lock according to this invention.

FIGS. 5 shows a block diagram of the electrical control circuit 50 which comprises a first timer circuit 66, a second timer circuit 67, a third timer circuit 68, and a fourth timer circuit 69. A first double change over contact relay 51 is connected to the first, second and fourth timer circuits 66, 67 and 69, and to the first control switch 10. A first reed relay 53 is connected to the second, third and fourth timer circuits 67, 68 and 69. A second double change over contact relay 52 is connected to the third timer circuit 68, to a warning device 60 and to a socket 61 for a central monitoring system. A second reed relay 54 is connected to the fourth timer circuit 69 and to an electromagnetic control unit 62. When actuated, the electromagnetic control unit 62 exerts a magnetic resistive force that prevents the motion of the key plug.

Figure 6:
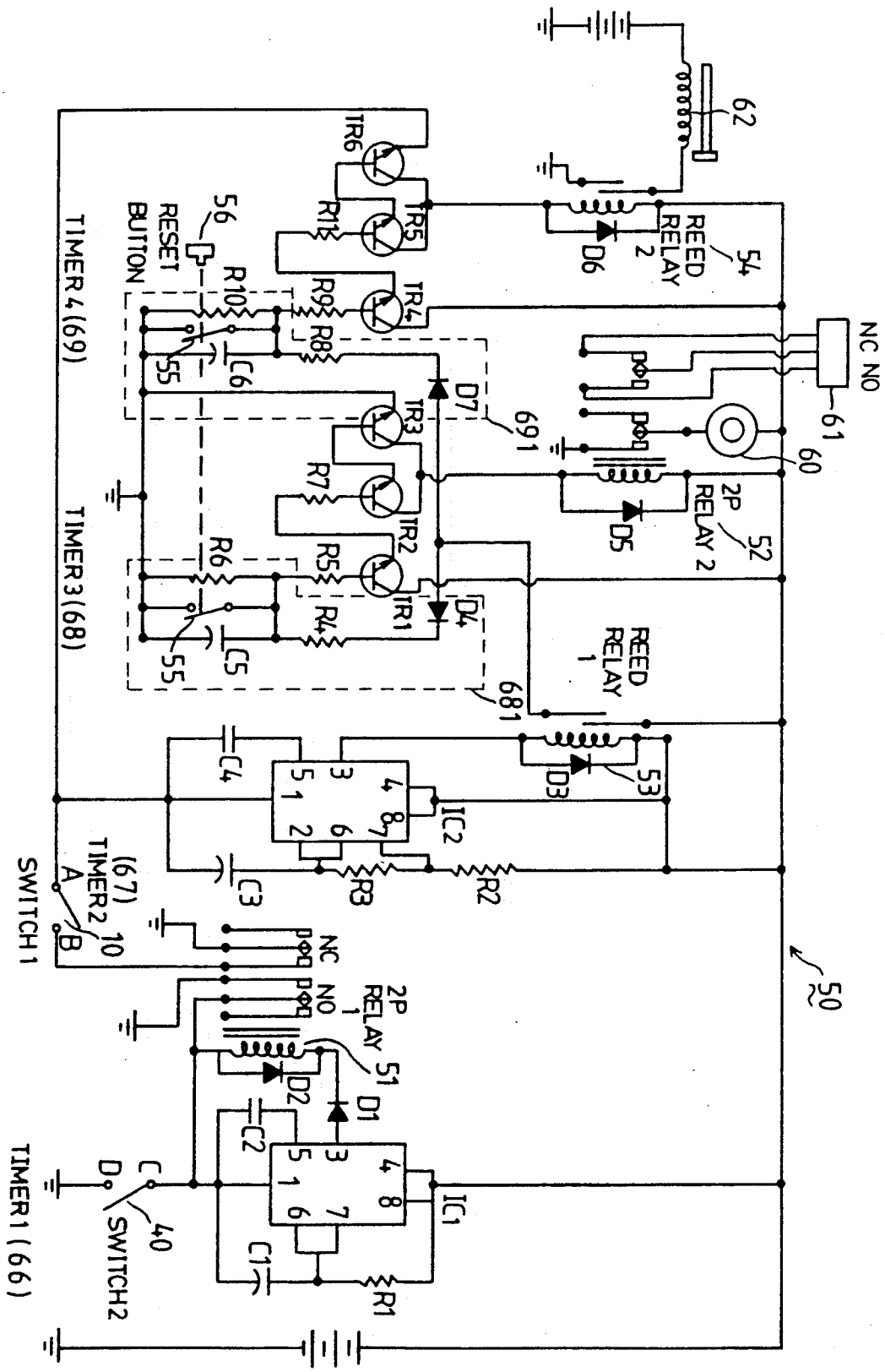
FIG. 6 is a schematic circuit diagram of the electrical control circuit of FIG. 5.

Referring to FIG. 6, the contact points A and B of the first control switch 10 refer to the conducting plate 11 and to the protruding tip 132 of one of the contact pieces 13 shown in FIGS. 1 and 2. The contact points C and D of the second control switch 40 refer to the first and second contact strips 423 and 424 shown in FIG. 4. The first timer circuit 66 comprises a timer IC1 (of the basic 555 type), a resistor R1, capacitors C1 and C2, and a diode D1. The first timer circuit 66 is configured so that when actuated, its time period provides ample time, such as 20 seconds, to open the lock. The second timer circuit 67 similarly comprises a timer IC2 (also of the basic 555 type), resistors R2 and R3 and capacitors C3 and C4. The second timer circuit 67 is also configured so that when it is actuated, it provides a time interval of about 5 seconds from the time the key is inserted into the key plug up to the rotation of the key plug. The third timer circuit 68 comprises a discharging network 681 serving as input to a transistor TR1 that is coupled to the base terminal of a darlington transistor pair TR2 and TR3. The discharging network 681 comprises a diode D4 having an anode connected the first reed relay 53, a resistor R4 having a first terminal connected to the cathode of the diode D4, a capacitor C5 connected to a second terminal of the resistor R4, and a resistor R6 connected in parallel to the capacitor C5. The third timer circuit 68 is designed to count down a predetermined amount of time, about 20 seconds. The fourth timer circuit 69 has a structure similar to the third timer circuit 68. The fourth timer circuit 69 comprises a discharging network 691 also serving as input to a transistor TR4 that is coupled to the base terminal of a darlington transistor pair TR5 and TR6. The discharging network 691 likewise comprises a diode D7 having an anode connected the first reed relay 53, a resistor R8 having a first terminal connected to the cathode of the diode D7, a capacitor C6 connected to a second terminal of the resistor R8, and a resistor R10 connected in parallel to the capacitor C6. The fourth timer circuit 69 is also designed to count down a predetermined amount of time, about 30 seconds. Diodes D2, D5, D3 and D6 are respectively connected across the coil of the relays 51, 52, 53 and 54. The construction of the relays 51, 52, 53 and 54 are known in the art and will not be detailed herein.

The lock further comprises a switch with two poles 55. Each pole 55 is connected across one of the capacitors C5 and C6 of the third and fourth timer circuits 68 and 69. A reset button 56 is used to actuate the double pole switch 55.

The operation of the preferred embodiment is as follows:

(1) When the correct key is received inside the keyplug, the points A and B come into contact to actuate the first control switch 10. The second timer circuit 67 starts counting down a period of about 5 seconds. If the key plug is rotated within the 5 second time period, the points C and D come into contact to actuate the first timer circuit 66. The first timer circuit 66 begins to count down a period of about 20 seconds, and at the same time, actuates the relay 51. The second, third and fourth timer circuits 67, 68 and 69 are not in operation when the relay 51 is in a conducting state. After about 20 seconds, the first timer circuit 66 automatically ceases to actuate the relay 51. If the lock has already been opened and the key is pulled out of the key plug, the second control switch 40 switches into an OFF state. Thus, if the key plug has been rotated within the 5 second time interval of the second timer circuit 67, and the lock has been opened within the 20 second time period of the first timer circuit 66, the warning device 60 and the electromagnetic control unit 62 will not have been actuated.

(2) If the key plug has not been rotated after 5 seconds, pin 3 of IC2 goes from a high state to a low state. The first reed relay 53 starts to conduct and the capacitor C5 is rapidly charged through the resistor R4. The darlington transistor pair TR2 and TR3 begins to conduct when the transistor TR1 acquires sufficient bias voltage. This defines the operation of the third timer circuit 68. When the darlington transistor pair TR2 and TR3 conducts, which occurs right after the second timer circuit 67 has been actuated, the warning device 60 starts to send out an alarm signal. The period of the alarm signal sent out by the warning device 60 is controlled by the capacitor C5 and the resistor R6 of the discharging network 681. The warning device 60 will keep on sending out the alarm signal for a predetermined time interval, such as 20 seconds, even when the key has already been pulled out of the keyplug.

(3) In conditions similar to those disclosed in step (2), when the first reed relay 53 starts to conduct, the capacitor C6 is rapidly charged through the resistor R8. The darlington transistor pair TR5 and TR6 begins to conduct when the transistor TR4 acquires sufficient bias voltage. This defines the operation of the fourth timer circuit 69. The conduction of the darlington transistor pair TR5 and TR6, which occurs right after the actuation of the second timer circuit 67, actuates the second reed relay 54 and the electromagnetic control unit 62. The electromagnetic control unit 62 prevents the rotation of the key plug and resists efforts to open the lock. The electromagnetic control unit 62 may be constructed to prevent the rotation of the T-shaped latch, thereby also preventing the rotation of the key plug and thus resisting any effort to open the lock. The period of operation of the electromagnetic control unit 62 is controlled by the capacitor C6 and the resistor R10 of the discharging network 691. As with the warning device 60, the electromagnetic control unit 62 will prevent the rotation of the keyplug for a predetermined time interval, such as 30 seconds.

(4) If a new key is inserted into the key plug after the 20 second time period of the third timer circuit 68 but within the 30 second time period of the fourth timer circuit 69, the electromagnetic control unit 62 remains in an actuated state until the expiration of the 30 second time period. The insertion of the new key also actuates the second timer circuit 67 to start a new count. Thus, the lock cannot be opened even if the correct key is inserted into the keyplug should one fail to wait for the fourth timer circuit 69 to become fully discharged.

(5) Should one forget to remove the key from the key plug after opening the door, the warning device 60 will send out the alarm signal and the electromagnetic control unit 62 will eventually be actuated. The alarm signal issued by the warning device 60 serves as a reminder that the key is still in the key plug. After extracting the key, the reset button 56 can be pressed to short out the capacitors C5 and C6, thus stopping the operation of the third and fourth timer circuits 68 and 69.

Ideally, the fourth timer circuit 69, which controls the operation of the electromagnetic control unit 62, should have the longest time period, followed by the third timer circuit 68, and the second timer circuit 67. The preferred time periods are 30 seconds, 20 seconds and 5 seconds, respectively, for the fourth, third and second timer circuits 69, 68 and 67. The time period of the fourth timer circuit 69 is preferably longer than the sum of the time periods of the third and second timer circuits 68 and 67 to allow continuous operation of the electromagnetic control unit 62 should a series of keys be inserted into the keyplug before the fourth timer circuit 69 has been fully discharged.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A lock with an electronic warning system comprising a hollow lock body with a plurality of aligned first transverse holes, a cylindrical key plug rotatably disposed inside said lock body and having a plurality of second transverse holes aligned with said first transverse holes, and a plurality of tumbler pins, each of said tumbler pins extending into one set of said aligned said first and said second transverse holes, said lock further comprising:

a first control switch actuated by inserting a key into said key plug;

a second control switch actuated by rotating said key plug relative to said lock body; and an electrical control means including a first timer means connected to said second control switch, a second timer means connected to said first control switch, a first electrical relay means interconnecting said first and said second timer means, and a warning device actuated by said second timer means, said first timer means disabling said second timer means for a predetermined time period when said first timer means is actuated;

whereby, said warning device sends out alarm signals for a predetermined period of time if said key plug has not been rotated after said second timer means has counted down a preset time period.

2. The lock as claimed in claim 1, further comprising an electromagnetic control unit also actuated by said second timer means, said electromagnetic control unit preventing the rotation of said key plug for a predetermined period of time if said key plug has not been rotated after said second timer means has counted down a preset time period.

3. The lock as claimed in claim 2, wherein said hollow lock body has a receiving groove; said first control switch comprising:

a conducting plate disposed in said receiving groove and electrically connected to one of said first relay means and said second timer means;

an insulating sleeve member for said conducting plate; and a plurality of conductive contact pieces having a protruding tip extending inside said insulating sleeve member and slightly displaced from said conducting plate, each of said conductive contact pieces being movably biased against one of said tumbler pins and electrically connected to the other one of said first relay means and said second timer means;

whereby, said conductive contact pieces are urged by said tumbler pins to contact said conducting plate whenever a key is inserted into said key plug.

4. The lock as claimed in claim 3, wherein said insulating plate member has a plurality of aligned convex protrusions projecting from a bottom surface, each of said convex protrusions having a through hole to receive said protruding tip of one of said conductive contact pieces.

5. The lock as claimed in claim 2, wherein said second control switch comprises:

a hollow casing having a first and a second wall formed with aligned openings, said key plug extending into said aligned openings;

a first and a second conductive contact strip, each being electrically connected to one of said first timer means and to a ground point of said electrical control means, said first and said second conductive contact strips being disposed inside said hollow casing and being slightly displaced from one another; and a substantially annular insulating piece disposed inside said hollow casing and having a level section in contact with said first conductive contact strip, said insulating piece being rotated by said key plug to urge said first conductive contact strip to come into contact with said second conductive contact strip.

6. The lock as claimed in claim 5, wherein said cylindrical key plug has a rear end formed with an axial slot, said insulating piece having a radial inward projecting stub extending into said axial slot.

7. The lock as claimed in claim 2, wherein said warning device comprises a third timer means having a first discharging network actuated by said second timer means, said electromagnetic control unit similarly comprising a fourth timer means having a second discharging network actuated by said second timer means.

8. The lock as claimed in claim 7, further comprising a switch with two poles, each pole being connected across one of said first and said second discharging networks, said double pole switch shorting out said first and said second discharging networks to stop the operation of said warning device and said electromagnetic control unit when said double pole switch is actuated.

9. The lock as claimed in claim 2, wherein said second timer means has a time period shorter than the time periods of said third and said fourth timer means.

10. The lock as claimed in claim 9, wherein said second timer means has a time period of approximately 5 seconds.

11. The lock as claimed in claim 10, wherein said second timer means has a time period of approximately 20 seconds.

12. The lock as claimed in claim 9, wherein said fourth timer means has a time period longer than the summation of the time periods of said second and said third timer means.

13. The lock as claimed in claim 2, wherein said electrical control means further comprises a socket for a central monitoring system.

* * * * *